US010582583B2

(12) United States Patent
Krattiger

(10) Patent No.: US 10,582,583 B2
(45) Date of Patent: Mar. 3, 2020

(54) POWER SUPPLIES UTILIZING MULTIPLE TRANSFER FUNCTIONS

(71) Applicant: ERP POWER, LLC, Moorpark, CA (US)

(72) Inventor: Steven C. Krattiger, Northridge, CA (US)

(73) Assignee: ERP Power, LLC, Moorpark, CA (US)

( * ) Notice: Subject to any disclaimer, the term of this patent is extended or adjusted under 35 U.S.C. 154(b) by 0 days.

(21) Appl. No.: 16/375,808

(22) Filed: Apr. 4, 2019

(65) Prior Publication Data

US 2019/0313495 A1 Oct. 10, 2019

Related U.S. Application Data

(60) Provisional application No. 62/652,821, filed on Apr. 4, 2018.

(51) Int. Cl.
*H05B 33/08* (2006.01)
*H05B 37/02* (2006.01)

(52) U.S. Cl.
CPC ..... *H05B 33/0845* (2013.01); *H05B 37/0272* (2013.01)

(58) Field of Classification Search
None
See application file for complete search history.

(56) References Cited

U.S. PATENT DOCUMENTS

2002/0171373 A1 11/2002 Muthu
2003/0035307 A1 2/2003 Matsuura et al.
2010/0148586 A1 6/2010 Bollmann et al.
2013/0229120 A1 9/2013 Choutov et al.
2013/0249431 A1* 9/2013 Shteynberg ..... H05B 37/02 315/287

OTHER PUBLICATIONS

International Search Report and Written Opinion for Application No. PCT/US2019/025907, dated Jun. 20, 2019, 8 pages.

* cited by examiner

*Primary Examiner* — Dedei K Hammond
(74) *Attorney, Agent, or Firm* — Lewis Roca Rothgerber Christie LLP

(57) ABSTRACT

An LED driver includes a power input configured to receive an input power; a dimmer switch input configured to receive a brightness input; and a power supply coupled to the power input and the dimmer switch input, the power supply having a plurality of selectable transfer functions and a currently selected transfer function of the plurality of selectable transfer functions, the power supply being configured to generate an output power from the input power, the output power having a level based on a value of the brightness input and the currently selected transfer function.

20 Claims, 6 Drawing Sheets

POWER SUPPLIES UTILIZING MULTIPLE TRANSFER FUNCTIONS

CROSS REFERENCE TO RELATED APPLICATIONS

The present application claims priority to and the benefit of U.S. Provisional Application No. 62/652,821, filed on Apr. 4, 2018, the entire content of which is incorporated by herein by reference.

BACKGROUND

Dimmers are used to adjust the light output level of light sources, including LEDs. The relationship between the value selected by a dimmer and the output power provided to the light source coupled to the dimmer may be referred to as a transfer function. Different transfer functions may be better suited to different environments, for different purposes, and/or for use with different light sources.

SUMMARY

Aspects of embodiments of the present disclosure relate to a power supply having multiple selectable transfer functions for controlling a dimming function of lighting connected thereto.

Aspects of embodiments of the present disclosure provide an LED driver. The LED driver includes a power input configured to receive an input power; a dimmer switch input configured to receive a brightness input; and a power supply coupled to the power input and the dimmer switch input, the power supply having a plurality of selectable transfer functions and a currently selected transfer function of the plurality of selectable transfer functions, the power supply being configured to generate an output power from the input power, the output power having a level based on a value of the brightness input and the currently selected transfer function.

In some embodiments, the dimmer switch input is configured to be coupled to a dimmer switch to receive the brightness input from the dimmer switch.

In some embodiments, the dimmer switch input is configured to receive the brightness input from an external controller.

In some embodiments, the brightness input is a level set by an end-user.

In some embodiments, the LED driver includes a memory, the plurality of selectable transfer functions being stored on the memory.

In some embodiments, the plurality of selectable transfer functions define relationships between the value of the brightness input and the level of the output power generated by the power supply.

In some embodiments, the power supply is configured to receive a selection signal from an external programmer and to determine the currently selected transfer from the plurality of selectable transfer functions based on the selection signal.

In some embodiments, the LED driver includes a communication circuit configured to wirelessly communicate with the external programmer.

In some embodiments, the LED driver includes a port configured to receive the selection signal from the external programmer.

In some embodiments, the power supply is configured to transmit a plurality of identifiers corresponding to the selectable transfer functions to the external programmer.

In some embodiments, the power supply is configured to transmit the selectable transfer functions to the external programmer.

In some embodiments, the LED driver includes a controller, the controller being configured to receive the value of the brightness input, to determine the level of the output power based on the currently selected transfer function, and to control the power supply to generate the output power at the level of the output power.

In some embodiments, the currently selected transfer function comprises a ratio of the level of the input power to the level of the output power corresponding to the value of the brightness input.

In some embodiments, the currently selected transfer function comprises a value of the level of the output power corresponding to the value of the brightness input.

Aspects of embodiments of the present disclosure also disclose an LED driver that includes a memory, wherein a plurality of selectable transfer functions are stored on the memory; a dimmer switch input configured to receive a brightness input; a power supply configured to receive an input power and generate an output power utilizing the input power; and a processor configured to receive a selection, identify a currently selected transfer function of the plurality of selectable transfer functions based on the selection, and control a level of the output power generated by the power supply based on the brightness input and the currently selected transfer function.

In some embodiments, the LED driver includes a dimmer switch coupled to the dimmer switch input, the dimmer switch input being configured to receive the brightness input from the dimmer switch.

In some embodiments, the dimmer switch input is configured to receive the brightness input from an external controller.

In some embodiments, the power supply is configured to receive a selection signal from an external programmer and to determine the currently selected transfer from the plurality of selectable transfer functions based on the selection signal.

In some embodiments, the LED driver includes a communication circuit configured to wirelessly communicate with the external programmer.

In some embodiments, the LED driver includes a controller, the controller being configured to receive the value of the brightness input, to determine the level of the output power based on the currently selected transfer function, and to control the power supply to generate the output power at the level of the output power.

DETAILED DESCRIPTION

Figure 1:
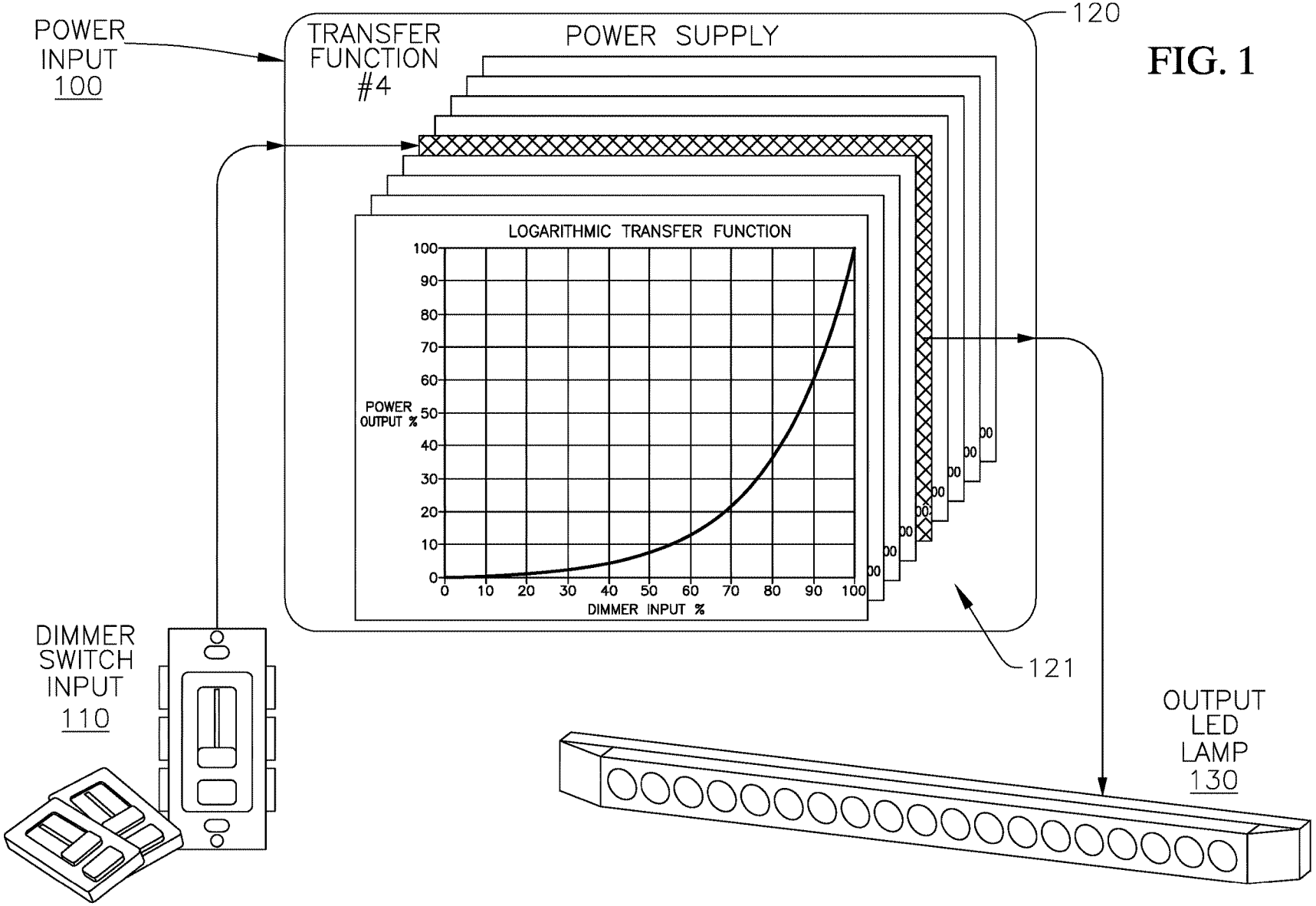
FIG. 1 is a block diagram of an LED lighting system according to embodiments of the present disclosure.

Features of the present disclosure and methods of accomplishing the same may be understood more readily by reference to the following detailed description of embodiments and the accompanying drawings. Hereinafter, embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

FIG. 1 is a block diagram of an LED lighting system according to embodiments of the present disclosure. The LED lighting system includes a power input 100, a dimmer switch input 110, a power supply 120, and an output LED lamp 130.

The LED lighting system receives power at the power input 100 which it uses to power the LED lamp 130 (or another light source). The dimmer switch input 110 receives a brightness input. In some embodiments, the dimmer switch input 110 may be a dimmer switch or may be coupled to a dimmer switch (or a similar device for selecting from a range of input values), and the brightness input may be input received from an end-user through the dimmer switch such as a level set by the user using the dimmer switch. In other embodiments, the dimmer switch input 110 receives a control signal from a control system coupled to the dimmer switch input 110, and the control signal is utilized as the brightness input value or is utilized to generate the brightness input value. The brightness input may have a value between a minimum brightness (e.g., 0%) and a maximum brightness (e.g., 100%).

The power supply 120 generates an output power using the power received at the power input 100, and applies the output power to the output LED lamp 130. The power supply 120 includes a plurality of selectable transfer functions 121. The power supply 120 may include a memory (e.g., a non-transitory computer readable medium), and the plurality of selectable transfer functions 121 may be stored on the memory. Each of the plurality of selectable transfer functions 121 defines a relationship between the value of the brightness input and the output power to be applied to the LED lamp 130. The power supply 120 generates the output power with a level based on the currently selected transfer function of the plurality of selectable transfer functions 121 and the most recent value of the brightness input received at the dimmer switch input 110. That is, the power supply 120 generates the output power at the level indicated by the currently selected transfer function corresponding to the most recent brightness input received.

The power supply 120 is configured to allow a user to select which of the plurality of selectable transfer functions the power supply 120 will use. In some embodiments, the power supply 120 includes a communication circuit configured to communicate with an external programmer, and the external programmer may be used to select the selectable transfer function. The communication circuit may connect to the external programmer wirelessly, for example using Wi-Fi, Bluetooth, or near-field communication protocols, and/or the power supply 120 may include a port for wired communication with the external programmer. The external programmer may run software configured to receive a selection of one of the plurality of selectable transfer functions 121 from a user and transmit the selected transfer function and/or an indicator of which transfer function was selected to the power supply 120. In some embodiments, the external programmer may also query the power supply 120 to identify the selectable transfer functions available, receive the identities of the selectable transfer functions, present the identities of the selectable transfer functions, and receive a selection of one of the available selectable transfer functions from the end-user. The power supply 120 may store an identifier of the selected transfer function on a non-transitory computer readable medium, and may check the identifier in determining what level of output power to generate based on the current brightness input value. In some embodiments, the external programmer may also query the power supply 120 to identify the selectable transfer functions available, receive the selectable transfer functions, display a graphical representation of one or more of the selectable transfer functions, and receive a selection of one of the available selectable transfer functions from the end-user.

In some embodiments, the external programmer may be a desktop computer, a smart phone, a tablet, or another device running application-specific software configured to communicate with the communication circuit of the power supply 120. In other embodiments, the external programmer may be an application-specific device configured to select a transfer function for the power supply 120.

In some embodiments where the communication circuit has a port for wired communication, the port may be positioned on the power supply 120 such that it is accessible after installation of the power supply 120, allowing an end-user to select the transfer function after installation. In alternative embodiments where the communication circuit has a port for wired communication, the port may be positioned inside a case of the power supply or at a position on the power supply which is not visible or easily accessible after installation. This configuration may allow a manufacturer, a distributor, a person installing the power supply, and/or another person familiar with the device to select the transfer function while obscuring this functionality from a layperson end-user, and preventing the port from being visible on the installed power supply 120.

In some embodiments, the power supply 120 additionally or alternatively includes an interface for selecting one of the plurality of selectable transfer functions 121. In some embodiments, the interface is a mechanical switch. In other embodiments, the interface includes one or more buttons, and/or a touch screen input coupled to a controller.

In some embodiments, the power supply 120 may be configured to determine which of the selectable transfer functions to utilize based on additional criteria. For example, in some embodiments, the additional criteria includes the current time, and the power supply 120 may utilize different selectable transfer functions at different times of the day. In some embodiments, the external controller can configure the additional criteria.

The power supply 120 may include a controller (e.g., a microcontroller) configured to utilize the selectable transfer functions. The controller may receive the brightness input value, determine an output power level based on the currently selected transfer function, and control the power supply 120 to generate output power at the determined level.

In some embodiments, the selectable transfer functions define the output power for a given value of the brightness input as a ratio of the power received at the power input 100 to the output power. That is, a given value of the brightness input may correspond to the output power being a set or predefined percentage of the power received at the power input 100. In other embodiments, the selectable transfer functions define the output power for a given value of the brightness input as a specified power level (e.g. a specific voltage or a specific current).

Although the embodiments described above have referred to the power supply 120 providing output power to an LED lamp 130, in some embodiments, the power supply 120 may output the output power to another lamp, such as an incandescent lamp. In some embodiments, the power supply 120 may include one or more selectable transfer functions configured for use with one or more LED lamps and one or more selectable transfer functions configured for use with non-LED lamps.

FIGS. 2A-E are graphs depicting selectable transfer functions for a power supply according to embodiments of the present disclosure.

Figure 2A:
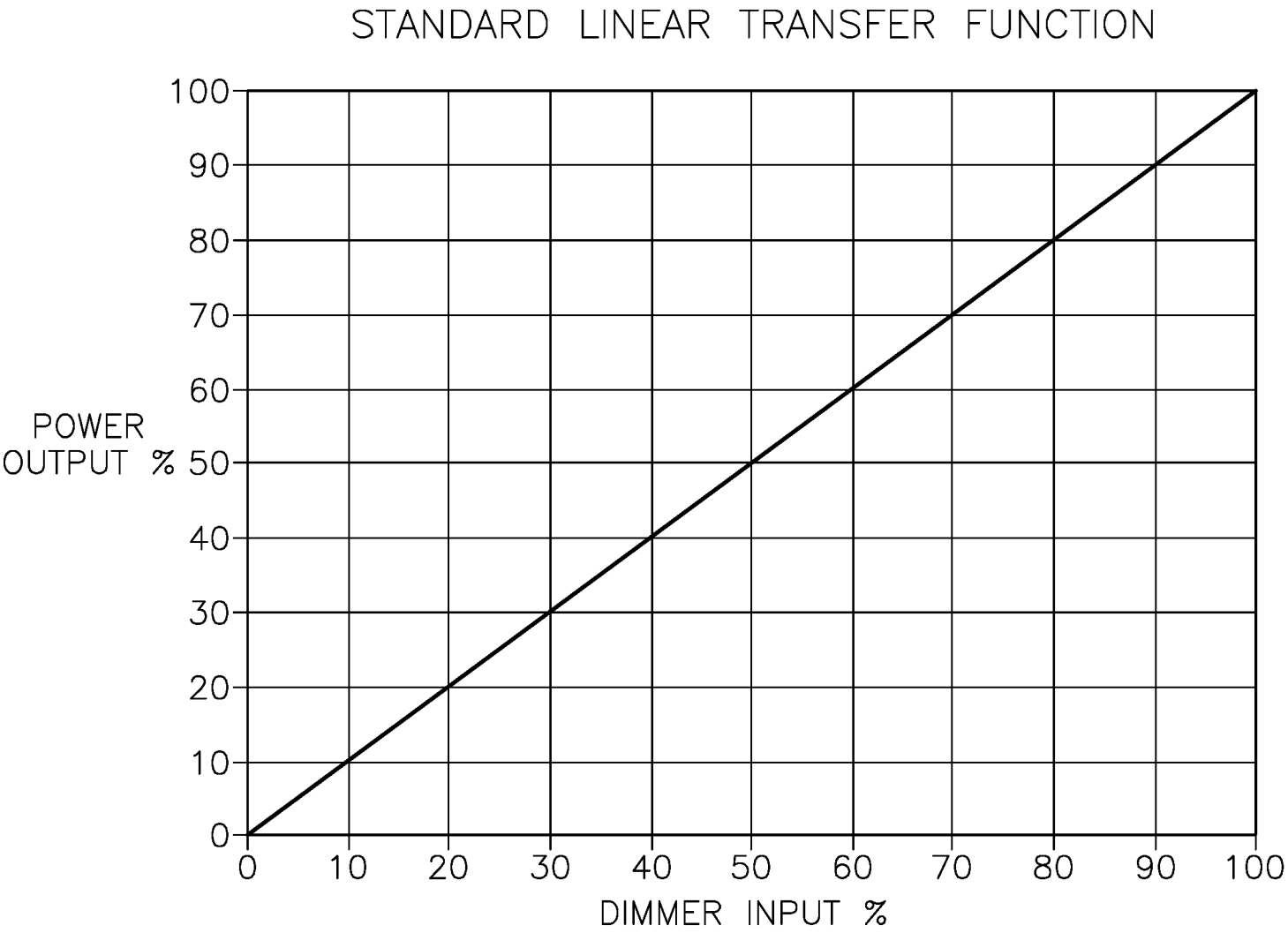
FIG. 2A is a graph depicting a selectable transfer function for a power supply according to embodiments of the present disclosure.

FIG. 2A shows a standard linear selectable transfer function. The power supply 120, generating an output power utilizing a standard linear selectable transfer function such as that of FIG. 2A as the currently selected transfer function, may be suitable for general purpose lighting or business or commercial environments.

Figure 2B:
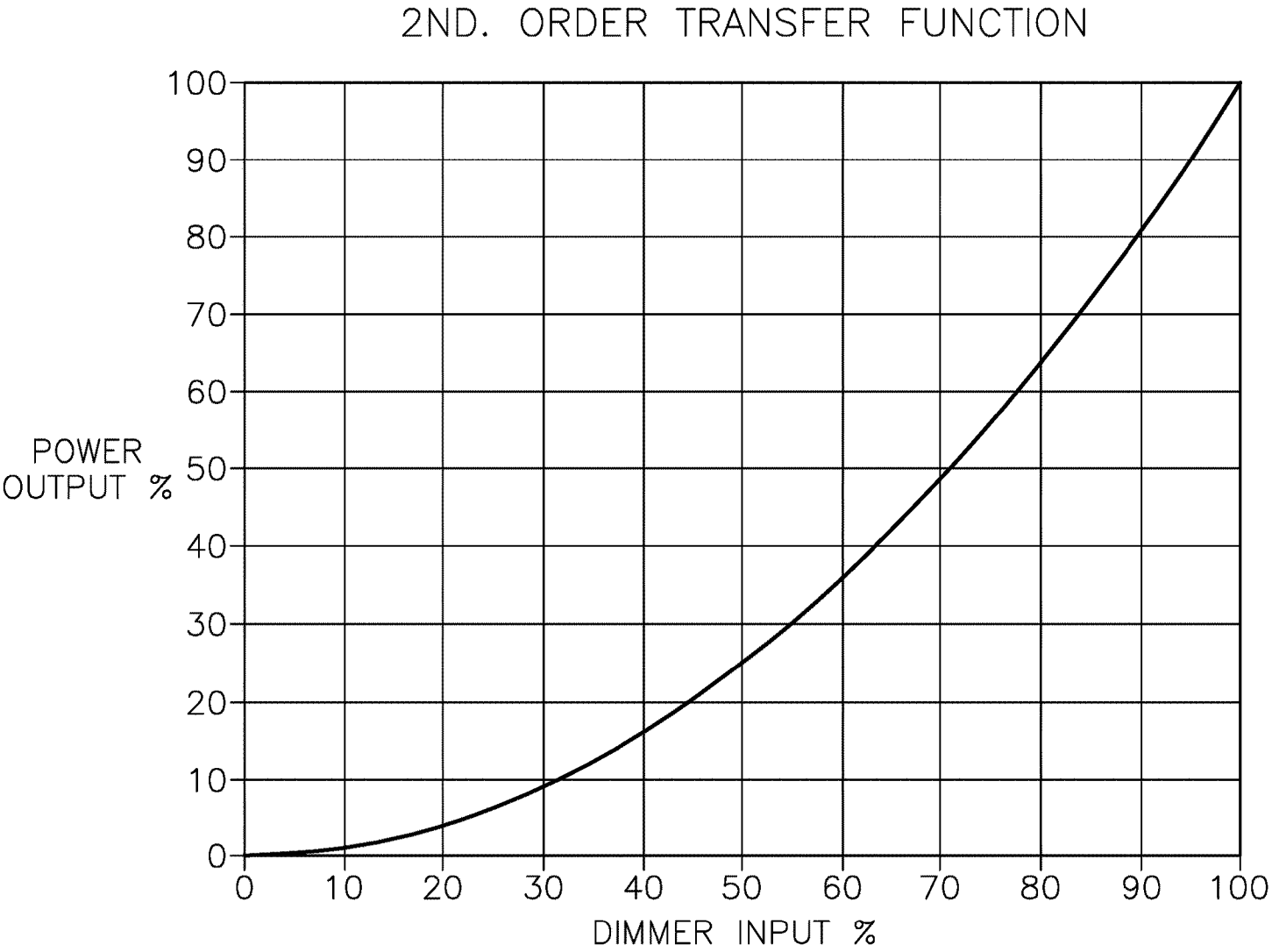
FIG. 2B is a graph depicting a selectable transfer function for a power supply according to embodiments of the present disclosure.
Figure 2C:
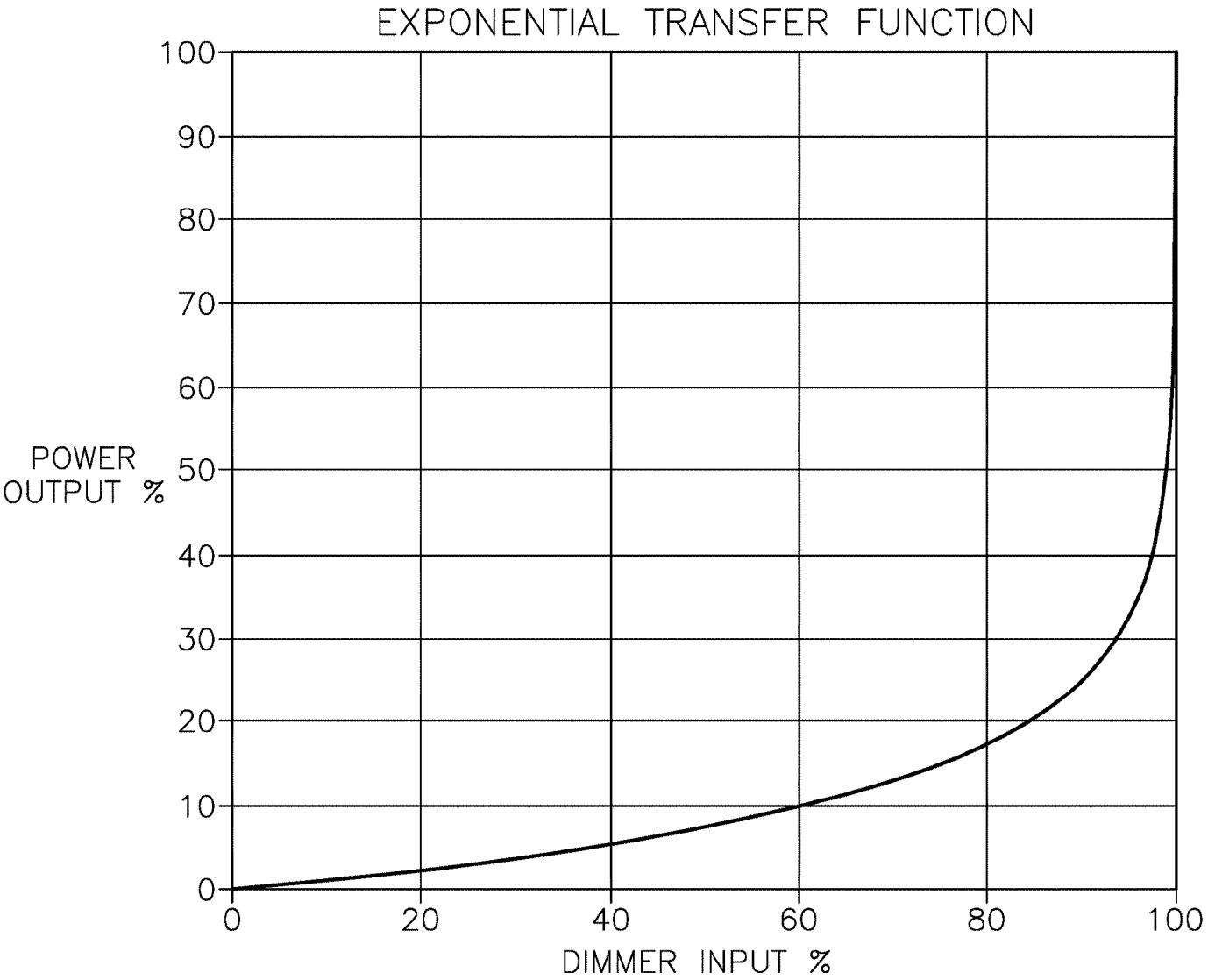
FIG. 2C is a graph depicting a selectable transfer function for a power supply according to embodiments of the present disclosure.
Figure 2D:
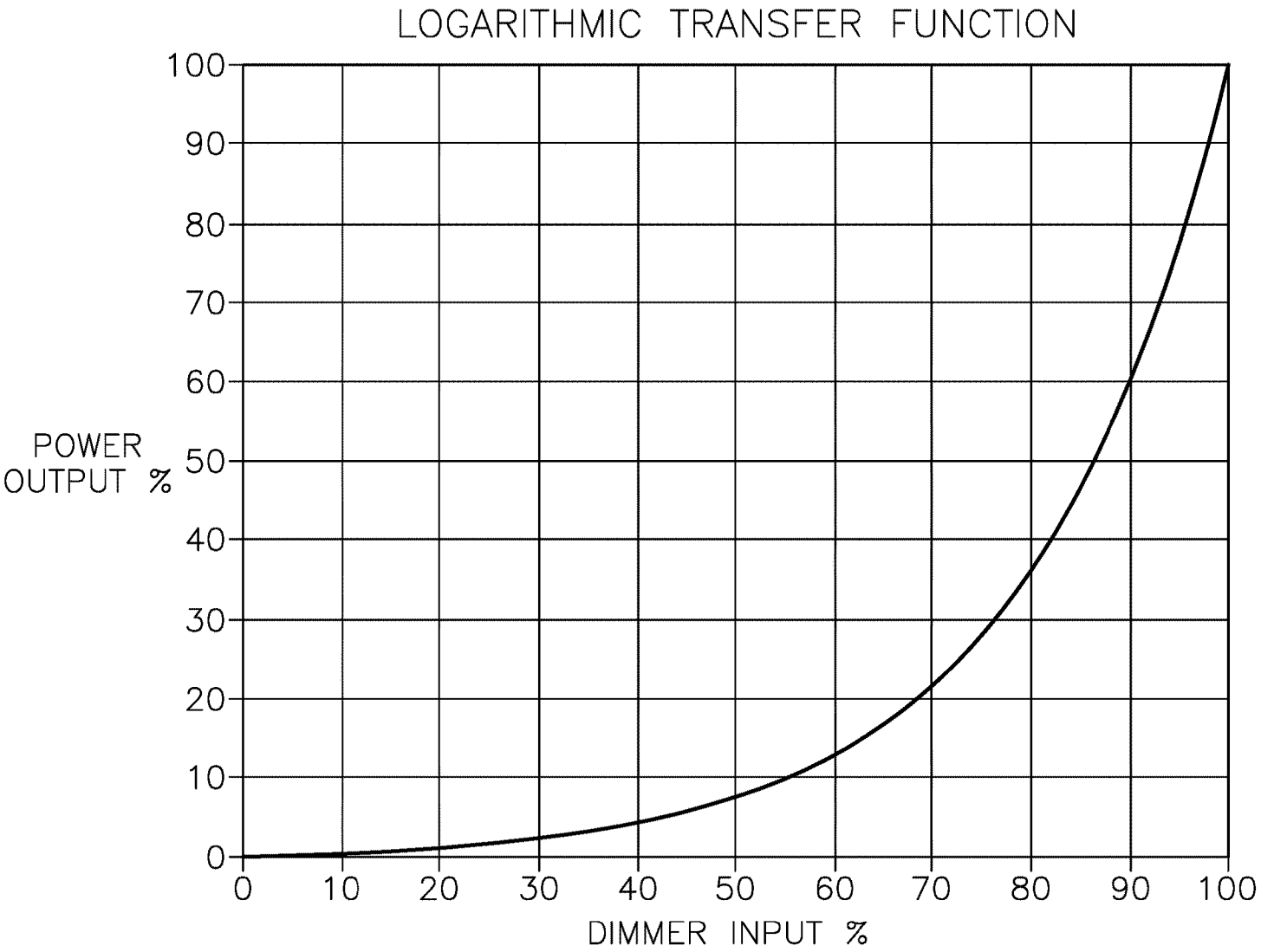
FIG. 2D is a graph depicting a selectable transfer function for a power supply according to embodiments of the present disclosure.

FIG. 2B shows a 2nd order selectable transfer function. FIG. 2C shows an exponential selectable transfer function. FIG. 2D shows a logarithmic selectable transfer function. The power supply 120, generating an output power utilizing a non-linear selectable transfer function such as one of those depicted in FIGS. 2B-2D as the currently selected transfer function, may be suitable for indoor and/or low-light environments.

Figure 2E:
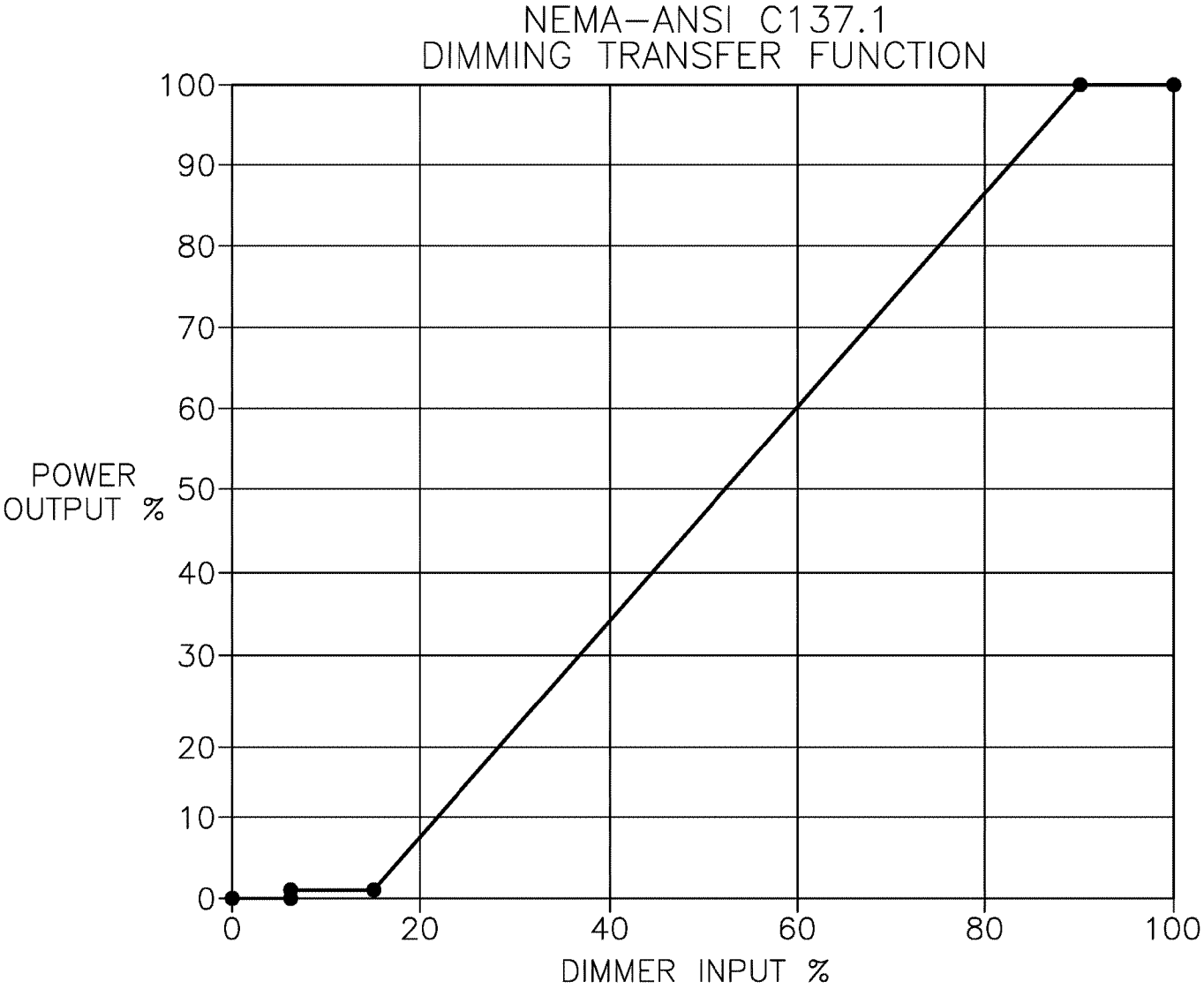
FIG. 2E is a graph depicting a selectable transfer function for a power supply according to embodiments of the present disclosure.

FIG. 2E shows a complex-non-linear selectable transfer function. The complex-non-linear transfer function may be configured to suit particular end-user needs. For example, the customized selectable transfer function may be configured to comply with an industry standard such that the power supply 120, generating an output power utilizing the customized selectable transfer function as the currently selected transfer function, is in compliance with the industry standard. The customized selectable transfer function depicted in FIG. 2E may be designed to comply with National Electrical Manufacturers Association's (NEMA) ANSI C137.1 standard for Lighting Control.

In some embodiments, a selectable transfer function may be configured based on the output characteristics of a particular lamp, including a particular LED lamp. For example, a particular LED lamp may have a non-linear relationship between the level of power supplied to the LED lamp and the luminance of the LED lamp. A selectable transfer function may account for this relationship, such that when the power supply 120 utilizes the selectable transfer function as the currently selected transfer function with the particular LED lamp, a desired relationship between the brightness input value and the particular LED lamp's luminance is achieved.

Accordingly, embodiments of the present disclosure may have some or all of the following features: a single power supply design can produce a dimmable output that follows any number of different curves, not just a single output curve; a power supply can be reconfigured by the end-user at the time of installation, or thereafter, to change lighting effects; a single power supply can be built that can be shipped to multiple customers that all have wide-varying needs for supply outputs; the power supply can operate as both a constant voltage and a constant current power supply; selectable transfer function curves may be implemented using a processor (e.g. a microprocessor) rather than complex analog circuitry; utilizing a microprocessor to implement transfer function curves (as opposed to analog circuitry) may result in a lower overall power supply cost.

The electronic or electric devices and/or any other relevant devices or components according to embodiments of the present invention described herein, such as power supply 120, may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

It will be understood that, although the terms "first," "second," "third," etc., may be used herein to describe various elements and/or components, these elements and/or components should not be limited by these terms. These terms are used to distinguish one element or component from another. Thus, a first element or component described above could be termed a second element or component without departing from the spirit and scope of the present invention.

The terminology used herein is for the purpose of describing particular embodiments only and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

While this invention has been described in detail with particular references to illustrative embodiments thereof, the embodiments described herein are not intended to be exhaustive or to limit the scope of the invention to the exact forms disclosed. Persons skilled in the art and technology to which this invention pertains will appreciate that alterations and changes in the described structures and methods of assembly and operation can be practiced without meaningfully departing from the principles, spirit, and scope of this invention, as set forth in the following claims and equivalents thereof.

What is claimed is:

1. An LED driver comprising:

a power input configured to receive an input power;

a dimmer switch input configured to receive a brightness input; and a power supply coupled to the power input and the dimmer switch input, the power supply having a plurality of selectable transfer functions and a currently selected transfer function of the plurality of selectable transfer functions, the power supply being configured to generate an output power from the input power, the output power having a level based on a value of the brightness input and the currently selected transfer function, wherein the power supply is further configured to determine the currently selected transfer function from the plurality of selectable transfer functions based on a selection signal.

2. The LED driver of claim 1, wherein the dimmer switch input is configured to be coupled to a dimmer switch to receive the brightness input from the dimmer switch.

3. The LED driver of claim 1, wherein the dimmer switch input is configured to receive the brightness input from an external controller.

4. The LED driver of claim 1, wherein the brightness input is a level set by an end-user.

5. The LED driver of claim 1, further comprising a memory, the plurality of selectable transfer functions being stored on the memory.

6. The LED driver of claim 1, wherein the plurality of selectable transfer functions define relationships between the value of the brightness input and the level of the output power generated by the power supply.

7. The LED driver of claim 1, wherein the power supply is configured to receive the selection signal from an external programmer.

8. The LED driver of claim 7, further comprising a communication circuit configured to wirelessly communicate with the external programmer.

9. The LED driver of claim 7, further comprising a port configured to receive the selection signal from the external programmer.

10. The LED driver of claim 7, wherein the power supply is configured to transmit a plurality of identifiers corresponding to the selectable transfer functions to the external programmer.

11. The LED driver of claim 7, wherein the power supply is configured to transmit the selectable transfer functions to the external programmer.

12. The LED driver of claim 1, further comprising a controller, the controller being configured to receive the value of the brightness input, to determine the level of the output power based on the currently selected transfer function, and to control the power supply to generate the output power at the level of the output power.

13. The LED driver of claim 1, wherein the currently selected transfer function comprises a ratio of the level of the input power to the level of the output power corresponding to the value of the brightness input.

14. The LED driver of claim 1, wherein the currently selected transfer function comprises a value of the level of the output power corresponding to the value of the brightness input.

15. An LED driver comprising:

a memory, wherein a plurality of selectable transfer functions are stored on the memory;

a dimmer switch input configured to receive a brightness input;

a power supply configured to receive an input power and generate an output power utilizing the input power; and a processor configured to receive a selection, identify a currently selected transfer function of the plurality of selectable transfer functions based on the selection, and control a level of the output power generated by the power supply based on the brightness input and the currently selected transfer function, wherein the power supply is further configured to determine the currently selected transfer function from the plurality of selectable transfer functions based on a selection signal.

16. The LED driver of claim 15, further comprising a dimmer switch coupled to the dimmer switch input, the dimmer switch input being configured to receive the brightness input from the dimmer switch.

17. The LED driver of claim 15, wherein the dimmer switch input is configured to receive the brightness input from an external controller.

18. The LED driver of claim 15, wherein the power supply is configured to receive the selection signal from an external programmer.

19. The LED driver of claim 18, further comprising a communication circuit configured to wirelessly communicate with the external programmer.

20. The LED driver of claim 15, further comprising a controller, the controller being configured to receive a value of the brightness input, to determine the level of the output power based on the currently selected transfer function, and to control the power supply to generate the output power at the level of the output power.

* * * * *